US005357240A

United States Patent [19]

Sanford et al.

[11] Patent Number: 5,357,240

[45] Date of Patent: Oct. 18, 1994

[54] EAS TAG WITH MECHANICALLY VIBRATING MAGNETIC ELEMENT AND IMPROVED HOUSING AND METHOD OF MAKING SAME

[75] Inventors: Robert J. Sanford, Coconut Creek; John Kowalczyk; John D. Wulf, both of Boca Raton, all of Fla.

[73] Assignee: Sensormatic Electronics Corporation, Deerfield Beach, Fla.

[21] Appl. No.: 962,274

[22] Filed: Oct. 16, 1992

[51] Int. Cl.[5] ..... G08B 13/14

[52] U.S. Cl. ..... 340/572; 206/818

[58] Field of Search ..... 340/572, 568, 551, 693; 29/592.1; 53/462; 206/460, 444, 818

[56] References Cited

U.S. PATENT DOCUMENTS

| | | | |
|---|---|---|---|
| 4,369,557 | 1/1983 | Vandebult | 340/572 X |
| 4,479,579 | 10/1984 | Miklos | 206/444 X |
| 4,510,489 | 4/1985 | Anderson, III et al. | 340/572 |
| 4,510,490 | 4/1985 | Anderson, III et al. | 340/572 |
| 4,632,250 | 12/1986 | Ueda et al. | 206/818 X |
| 4,694,283 | 9/1987 | Reeb | 340/572 |
| 4,745,401 | 5/1988 | Montean | 340/572 |
| 4,905,831 | 3/1990 | Bagdis et al. | 206/444 |

*Primary Examiner*—John K. Peng
*Assistant Examiner*—Thomas J. Mullen, Jr.
*Attorney, Agent, or Firm*—Robin, Blecker, Daley & Driscoll

[57] ABSTRACT

An EAS tag comprising a tag body having a central region, side wall regions connected to and integral with the central region and flap regions connected to and integral with the side wall regions. The tag body has fold lines at the junctions of the central and side wall regions and at the junctions of the side wall regions and the flap regions. By folding the tag body along these fold lines and, in the course of the folding procedure, inserting a first magnetic element, a substantially closed box-like housing with the first magnetic element loosely housed therein is formed.

63 Claims, 12 Drawing Sheets

EAS TAG WITH MECHANICALLY VIBRATING MAGNETIC ELEMENT AND IMPROVED HOUSING AND METHOD OF MAKING SAME

BACKGROUND OF THE INVENTION

This invention relates to tags for electronic article surveillance (EAS) systems and, in particular, to EAS tags utilizing magnetically vibrating magnetic elements.

U.S. Pat. Nos. 4,510,489 and 4,510,490 disclose tags and tag structures and an EAS system in which the tags are attached to articles in order to protect the articles from theft. In the system of these patents, each EAS tag contains a first magnetic element which mechanically vibrates at a predetermined frequency in response to an interrogation field at that frequency. This vibration alters the magnetic permeability of the first magnetic element, causing the magnetic element to produce a magnetic field at the predetermined frequency. This field can then be detected to sense the tag and, thus, the article carrying the tag.

In the EAS tag of the '489 and '490 patents, a second semi-hard or hard magnetic element is also used in the tag. This second magnetic element is placed in close proximity to the first element and, when magnetized, biases or arms the first magnetic element so that it will vibrate in response to the interrogation magnetic field at the predetermined frequency. By demagnetizing the second magnetic element, the bias is removed from the first magnetic element and it no longer resonates to produce a detectable magnetic field. The tag can thus be activated and deactivated by magnetizing and demagnetizing the second magnetic element, respectively.

In the EAS tag of the '489 and '490 patents, it is essential that the first magnetic element be housed in a manner which allows it to mechanically vibrate. It is also essential that the second magnetic element be correctly situated and held in the tag in appropriate proximity to the first magnetic element, but not so as to restrict the first magnetic element's vibration. Failure to meet these requirements causes the vibration of the first magnetic element to be adversely affected, thereby preventing the tag from satisfying the desired amplitude and frequency performance criteria.

In present EAS tags of this type, the tags are formed from a plastic material which carries a heat seal coating. This material is first subjected to a thermoforming process to form a rectangular box-like housing with an open top bordered by a surrounding flange. The first magnetic element is then inserted in the housing through the open top and a plastic sheet is placed over the top and heat sealed or laminated to the border flange to close the housing and loosely encase the first magnetic element.

The second magnetic element is adhesively secured to a first side of a carrier whose second side carries an adhesively attached peelable liner. The carrier first side is laminated or otherwise secured to the plastic sheet including the part of the sheet laminated to the housing flange. With the second magnetic element thus secured via the carrier to the housing, the tag is complete. When using the tag, the liner is peeled from the carrier and the exposed adhesive surface pressed against the article, thereby securing the tag and article together.

While the aforesaid tag has proved successful, there are certain features of the tag which limit its usefulness. For example, the flange of the housing, while needed to secure the plastic sheet closing the open end of the housing, increases the housing size and for many applications is aesthetically unattractive. This prevents use of the tag with certain types of articles and, hence, in certain markets.

Also, the thermoforming and laminating procedures carried out in fabricating the tag can result in bonding of the first magnetic element to the heat seal coatings of the tag body. If this occurs, the required mechanical vibration of the first magnetic element may be restricted and the resultant tag may not perform acceptably. Tags in which this happens have to be discarded. This results in process inefficiencies and material loss.

Furthermore, the heat seal coating of the flange of the tag body remains soft after the tag manufacture is completed. As a result, during shipment of the tag, the first element may become attached or lodged against the coating. In such case, the tag will not perform satisfactorily, resulting in the return of the tag by the purchaser and reduced confidence of the purchaser in the product.

It is therefore an object of the present invention to provide an EAS tag of the above-type which does not suffer from the drawbacks of the prior tags.

It is a further object of the present invention to provide an EAS tag of the above-type which is smaller in size and aesthetically more pleasing.

It is a further object of the present invention to provide an EAS tag of the above-type which is such that the first magnetic element of the tag is less likely to be hindered by the tag body.

It is a further object of the present invention to provide an apparatus and method for making a tag meeting the above-mentioned objectives.

SUMMARY OF THE INVENTION

In accordance with the principles of the present invention, the above and other objectives are realized in a tag comprising a tag body having a central region, side wall regions connected to and integral with the central region and flap regions connected to and integral with the side wall regions. The tag body has fold lines at the junctions of the central and side wall regions and at the junctions of the side wall regions and the flap regions. By folding the tag body along these fold lines and, in the course of the folding procedure, inserting the first magnetic element, a substantially closed box-like housing with the first magnetic element loosely housed therein is formed.

In carrying out the forming and folding operation, the side wall regions are raised to an upstanding position, the first element is then placed on the central region and the flaps folded together to close the opening above the side walls. The closed flaps thus form a cover facing the central region and spaced therefrom by the height of the side wall regions. The closed box-like housing thus results.

To complete the tag, a carrier carrying the second magnetic element is adhesively secured on one side to the cover formed by the flaps. This leaves accessible a peelable liner on the second side of the carrier so that it can be peeled off to expose an adhesive layer for securing the tag to an article.

A method and apparatus are also disclosed for forming the tag in which a sequence of folding and forming procedures using mating mandrels and dies at different stations are carried out on a single sheet or strip of material. These forming and folding procedures create the fold lines in the strip and fold the strip along these lines to develop the box-like tag housing with the first magnetic element housed therein. Also, at other stations, procedures for applying adhesive and the second magnetic element to the peelable liner are carried out to form the carrier. The formed carrier and tag housing are then brought to a common station and joined together to complete the tag. In the method and apparatus disclosed, multiple tags are formed with each processing cycle.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
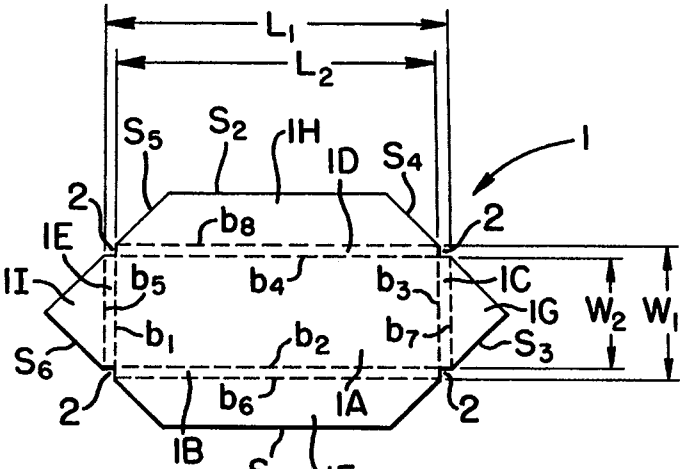
FIG. 1 shows a plan view of an unfolded tag body of an EAS tag in accordance with the principles of the present invention.

FIG. 1 shows a thin sheet or strip of material 1 which can be used to form a box-like tag body 10 (see, FIG. 5) of an EAS tag 20 (see, FIG. 6) in accordance with the principles of the present invention. The material used for the strip 1 can be a bendable, relatively stiff plastic or paper-like material. A typical material might be, for example, polyvinylchloride (PVC).

As shown, the strip 1 is hexagonal in configuration with two equal length longer sides $S_1$, $S_2$ and four equal length shorter sides $S_3$, $S_4$, $S_5$ and $S_6$. Each of the sides $S_3$-$S_6$ has a notch 2 at about midway along its length. The notches 2 facilitate the bending of the strip 1 to form a first set of bend lines $b_1$-$b_4$ and a second set of bend lines $b_5$-$b_8$. These bend lines, in turn, segment the sheet into a central region 1A, side wall regions 1B-1E contiguous and integral with the central region and flap regions 1F-1I contiguous and integral with the side wall regions 1B-1E, respectively.

As shown, the central region 1A and the side wall regions 1B-1E are rectangular, the flap regions 1G and 1I are trapezoidal and the flap regions 1F and 1H are triangular. Moreover, the notches 2 are L shaped with equal sides or legs and positioned such that the sides of each trapezoidal flap and the sides of each triangular flap are all equal. With the regions and the bend lines of the strip 1 so defined, the strip 1 can be formed into a box-like tag body enclosing a first magnetic element, as will be discussed more fully below in connection with the forming steps schematically illustrated in FIGS. 2-6.

Figure 2:
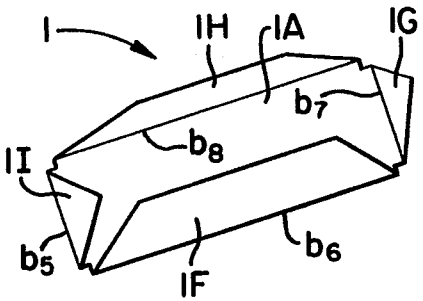
FIG. 2 shows a perspective view of the tag body of FIG. 1 after a first folding procedure.

More particularly, FIG. 2 shows the sheet 1 after being subjected to a die and mandrel forming operation to form the first set of bend lines $b_5$-$b_8$ defining the flaps regions 1F-1I. In this case, a die and a cooperating or mating flat mandrel having width and length dimensions $W_1$ and $L_1$, act on the strip 1 to create the bend lines and flap regions which extend outwardly from the sheet, as shown in FIG. 2.

After this first forming and bending operation, a mechanically vibratable first magnetic element 3 of width and length dimension $W_3$ and $L_3$ is placed against the central region 1A. The magnetic element 3 can comprise a ferromagnetic material (e.g., a magnetostrictive ferromagnetic material) of the type described in the aforementioned '489 and '490 patents, the teachings of which are incorporated herein by reference. A second die and mandrel operation is then performed. In this situation, the die and its mating flat mandrel have width and length dimensions $W_2$ and $L_2$. As a result, they create the further bend lines $b_1$-$b_4$ in the strip 1 which together with the previously created bend lines $b_5$-$b_8$ define the side wall regions 1B-1E.

Figure 3:
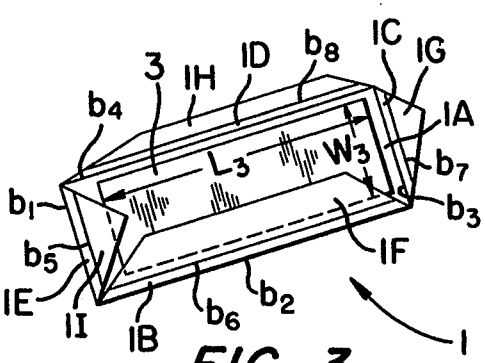
FIG. 3 shows in perspective view the tag body of FIGS. 1-2 after a second folding procedure and after insertion of a first magnetic element.

The resultant form of the strip 1 is as shown in FIG. 3. As can be seen, the side wall regions 1B-1E and the flap regions 1F-1I are upstanding and the first magnetic element 3 lies on the central region 1A. By making the dimensions $W_3$ and $L_3$ of the first magnetic element 3 less than the dimensions $W_2$and $L_2$ of the central region 1A, the first magnetic element 3 is spaced from and free of the side wall regions 1B-1E. The first magnetic element is thus able to expand and contract without hinderance from the side walls of the strip 1, as is required for its mechanical vibration.

Also, the height H of the side wall regions 1B-1E (determined by the length of the sides or legs of the notches 2) is made larger than the thickness t of the first magnetic element 3. This also prevents the flap regions from restricting movement of the element when the flaps are closed as described more fully below.

Figure 4:
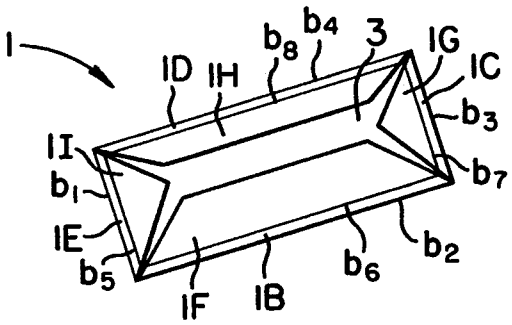
FIG. 4 shows the tag body of FIGS. 1-3 after a third folding procedure.

With the strip 1 held in a die of the same dimensions as that used in the immediately preceding operation, a further die and mandrel operation is performed. In this case, the mandrel used has flat sides that are angled outwardly at a 45° angle. These sides terminate at an outward end which has width and length dimensions $W_4$ and $L_4$ that are slightly less than $W_2$ and $L_2$, respectively. As a result, the mandrel acts on the side walls 1B–IE of the strip 1 to cause overbending at the bend lines $b_1$–$b_4$. This results in the flaps and their contiguous side walls being bent inwardly at these bend lines. This brings the flaps and side walls toward each other and partially closes the open area above the side walls and flaps. FIG. 4 depicts this situation.

In a final die and mandrel operation, the strip 1 is again held in a die of the same dimensions as in the previous two operations. In this case, a flat mandrel with width and length dimensions also slightly less than $W_2$ and $L_2$, respectively, is employed. This mandrel acts on the outer surfaces of flaps 1F–1I to cause overbending at the bend lines $b_5$–$b_8$. This urges the partially closed flaps 1F–1I further together until they substantially mate and close the opening above the now upstanding side wall regions 1B–1E. The mandrel is also slightly shouldered in the configuration of the closed flaps to prevent overlapping of the flaps when they become closed.

In this position, the flaps define a cover 10A which faces and is spaced by the side wall height H from the central region 1A and the magnetic element 3. This results in a closed rectangular box-like tag body 10 as shown in FIG. 5 in which the first magnetic element 3 is loosely housed within the body so as to be able to undergo mechanical vibration.

Figure 6:
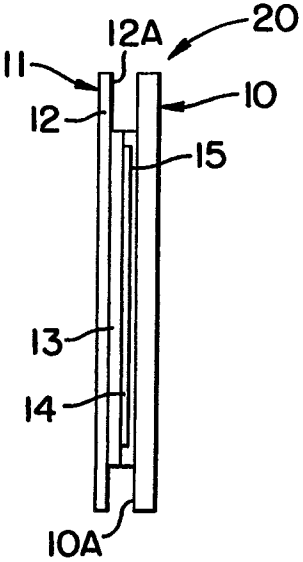
FIG. 6 shows the tag body of FIG. 5 to which a carrier for a second magnetic element has been affixed to form a completed tag.
Figure 5:
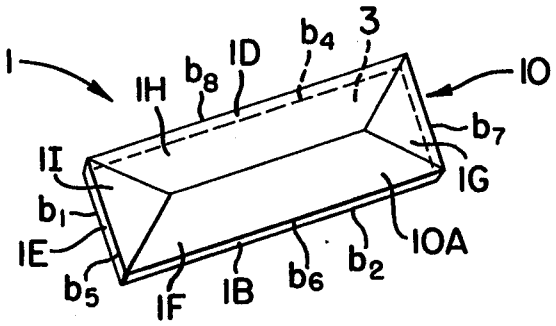
FIG. 5 shows the tag body of FIGS. 1-4 after a fourth folding procedure.

The tag body 10 of FIG. 5 is formed into a completed tag as shown in FIG. 6 by securing a carrier 11 to the body. The carrier 11 includes a liner 12 which carries on one side 12A a first layer of adhesive 13. The adhesive layer 13 has length and width dimensions $L_2$ and $W_2$ so as to encompass the cover 10A defined by the closed flaps 1F–1I of the tag body 10.

A semi-hard or hard second magnetic element 14 of the type described in the '489 and '490 patents for biasing the magnetic element 3 so it can mechanically vibrate is secured to the adhesive layer 13. The magnetic element 14 is of length and width dimension slightly less than that of the adhesive layer. A second adhesive layer 15 of dimension similar to that of the layer 13 overlies the second magnetic element 14 and the portion of the layer 13 extending beyond the magnetic element.

The carrier 11 is affixed to the tag body 10 by pressing the adhesive layer 15 onto the cover 10A. This ensures that the flaps 1F–1I defining the cover are held in closed position and also fills any void areas which may exist between the flaps.

When the finished tag 20 is to be used, the liner 12 is removed or peeled from the adhesive layer 13, leaving the layer exposed. The layer 13 is then pressed against the article receiving the tag 20 and the tag thereby secured to the article.

As can be appreciated, the completed tag 20 of FIG. 6 has straight side wall regions 1B–1E which define the external limits of the tag without the presence of a surrounding flange. This gives the tag an aesthetically pleasing streamlined appearance, making it more acceptable for use in EAS applications.

Furthermore, the tag body 10 is of one-piece or integral folded construction and does not require the use of thermoforming or heat sealing procedures during formation. Accordingly, the first magnetic element 3 is not exposed to heat sealed surfaces to which it can attach or become lodged. The ability of the element 3 to vibrate is thus not compromised by the tag body or the formation process. As a result, an overall more acceptable tag 20 from a visual and performance standpoint is realized.

While the method of fabricating the tag 20 has been illustrated above in terms of fabricating a single tag, FIGS. 7–9 show an assembly 70 which is adapted to extend the procedure to multiple tag production. In the assembly 70, a continuous length of bendable, relatively stiff plastic or paper-like material 101 is fed from a roll 102 and pulled to a punching station 72. At the punching station, a predefined segment 101A of the conveyed material is punched with an array of square punches 72A.

Figure 10:
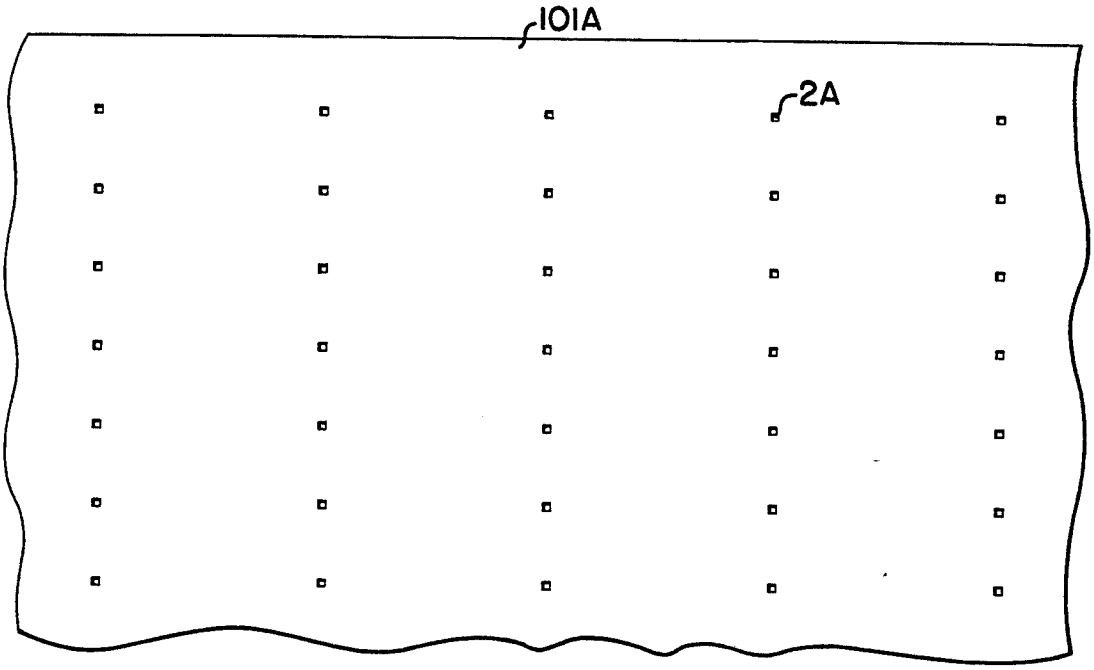
FIG. 10 shows a segment of material after being subjected to a die punch operation in the apparatus of FIGS. 7-9.

As shown in FIG. 10, these punches create rows and columns of square holes 2A in the segment of material 101A. The holes 2A, in turn, are used to form the notches 2 in a plurality of strips 1 to be cut or punched from the segment 101A.

Figure 11:
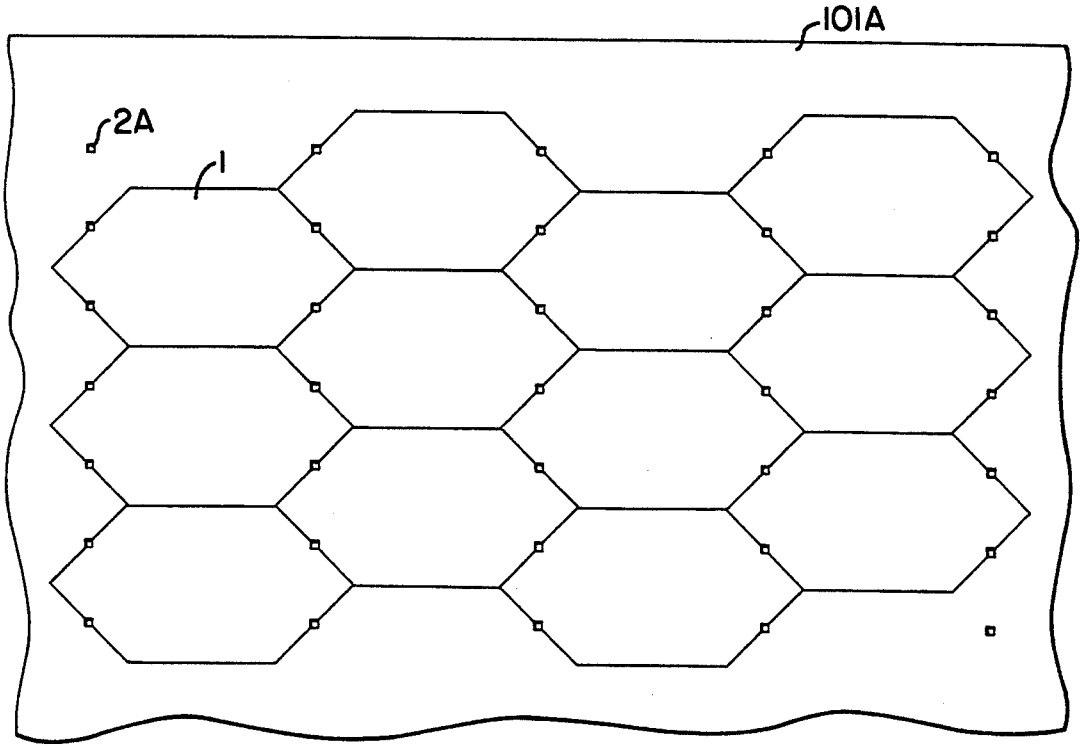
FIG. 11 shows the segment of material of FIG. 10 after being further subjected to a die cutting operation in the apparatus of FIGS. 7-9.

From the punch station 72, the continuous web of material 101 is pulled to bring the punched segment 101A to an idle station 73 where the segment awaits entry onto a cutting station 74. At the cutting station 74, the punched segment 101A is cut by a predetermined cutting die 74A to create a plurality of hexagonal strips 1 in the punched segment 101A. These strips 1 are not cut completely through and remain loosely attached to the segment 101A which itself is fully detached by the die 74A from the remainder of the material 101. The cut segment 101A with the strips 1 is shown in FIG. 11.

Upon leaving the cutting station 74, the segment 101A is brought to a first station 81B of an indexing table assembly 81. The indexing table assembly 81 carries die assemblies 82 and ejector assemblies 83 (see, FIG. 9) which are jointly indexed (incrementally moved) to various stations around the table. The table assembly 81 also supports at certain of these stations mandrel arrays for interacting with each die assembly 82 as it is indexed to the station.

Figure 12:
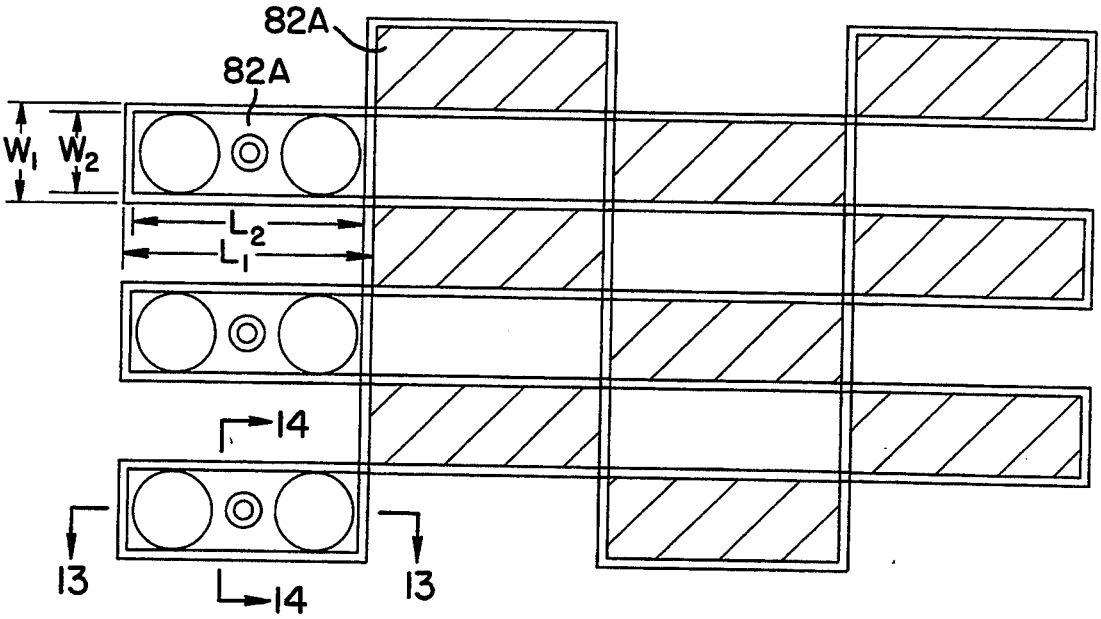
FIG. 12 shows part of a die cavity assembly used in the apparatus of FIGS. 7-9.
Figure 15:
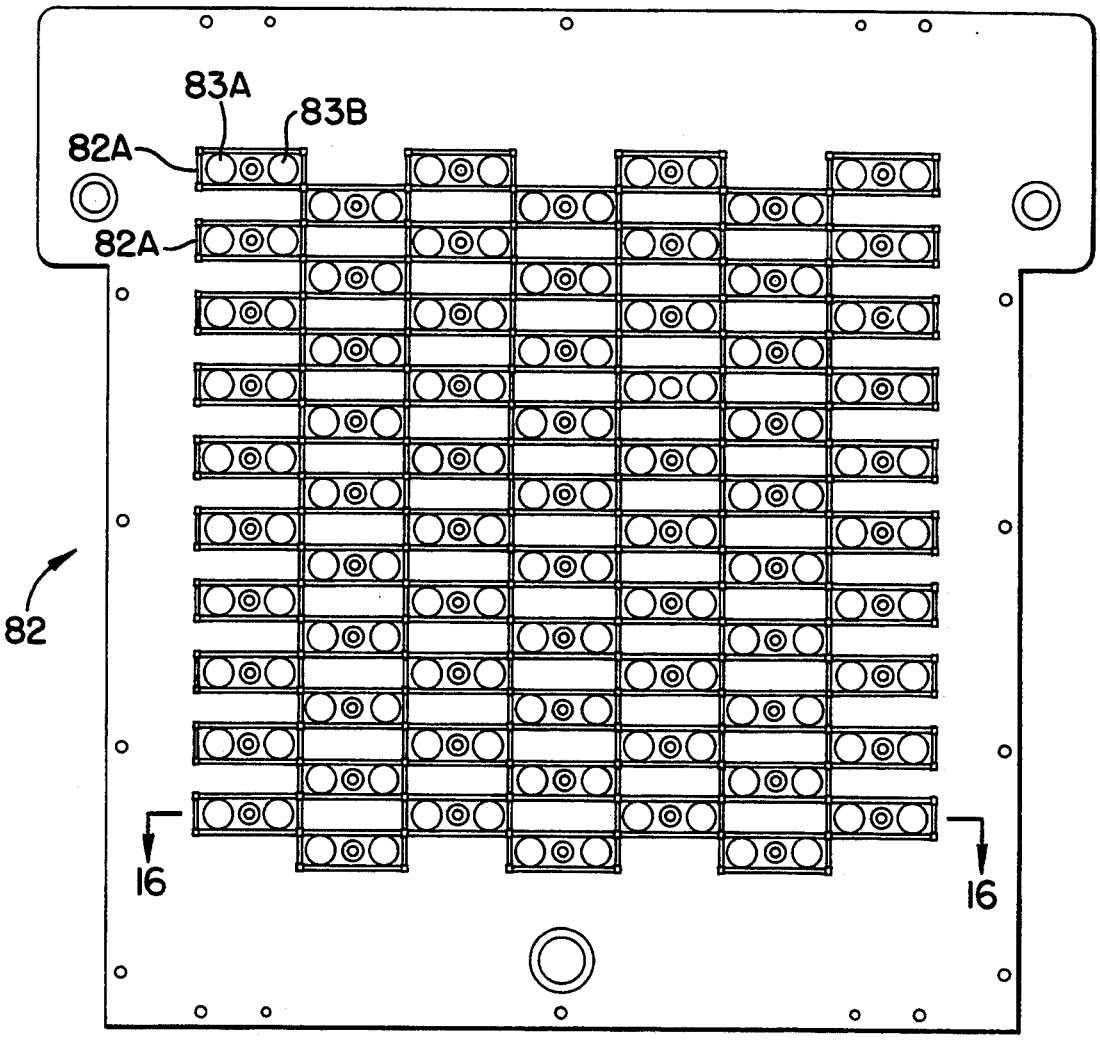
FIG. 15 shows a complete die cavity assembly of the apparatus of FIGS. 7-9.

FIG. 12 shows an enlarged partial view and FIG. 15 a complete view of one of the die assemblies 82. As shown, the assembly 82 includes a checkerboard array of like die cavities 82A equal in number to the strips 1 formed on the material segment 101A. Each die cavity 82A in the array is used to form a particular strip 1 into a tag body 10 as will be discussed in more detail below.

Figure 13:
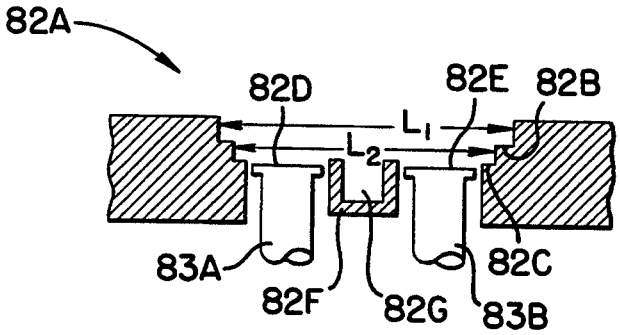
FIGS. 13 and 14 shows cross sections of a die cavity of the die cavity assembly of FIG. 12.
Figure 14:
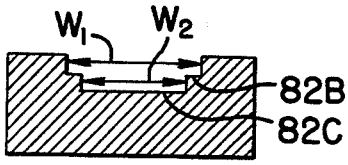
Figure 16:
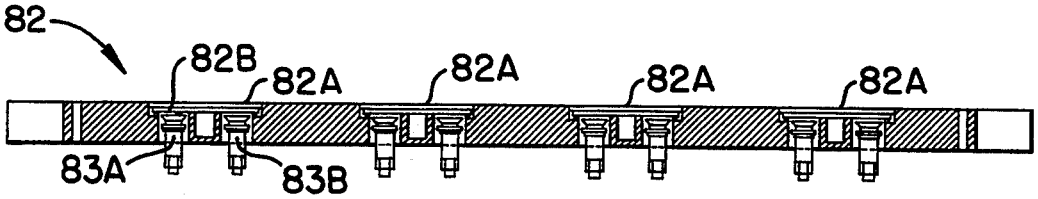
FIG. 16 shows a cross section through a section 16-16 of the die cavity assembly of FIG. 15.

FIGS. 13 and 14 show cross sections through one of the die cavities 82A of the die assembly 82. These cross sections have been taken along the lines 13—13 and 14—14 of the die assembly as shown in FIG. 12. FIG. 16 shows a further cross-section of a line of the die cavities taken along line 16—16 in FIG. 15.

As can be seen from these figures, each die cavity 82A is stepped so as to define upper and lower sub-cavities 82B and 82C of length and width dimensions $L_1$ and $W_1$ and $L_2$ and $W_2$, respectively. These sub-cavities are used to form the sets of fold lines $b_5$–$b_8$ and $b_1$–$b_4$, respectively, in a corresponding strip 1, as is discussed below.

Figure 17:
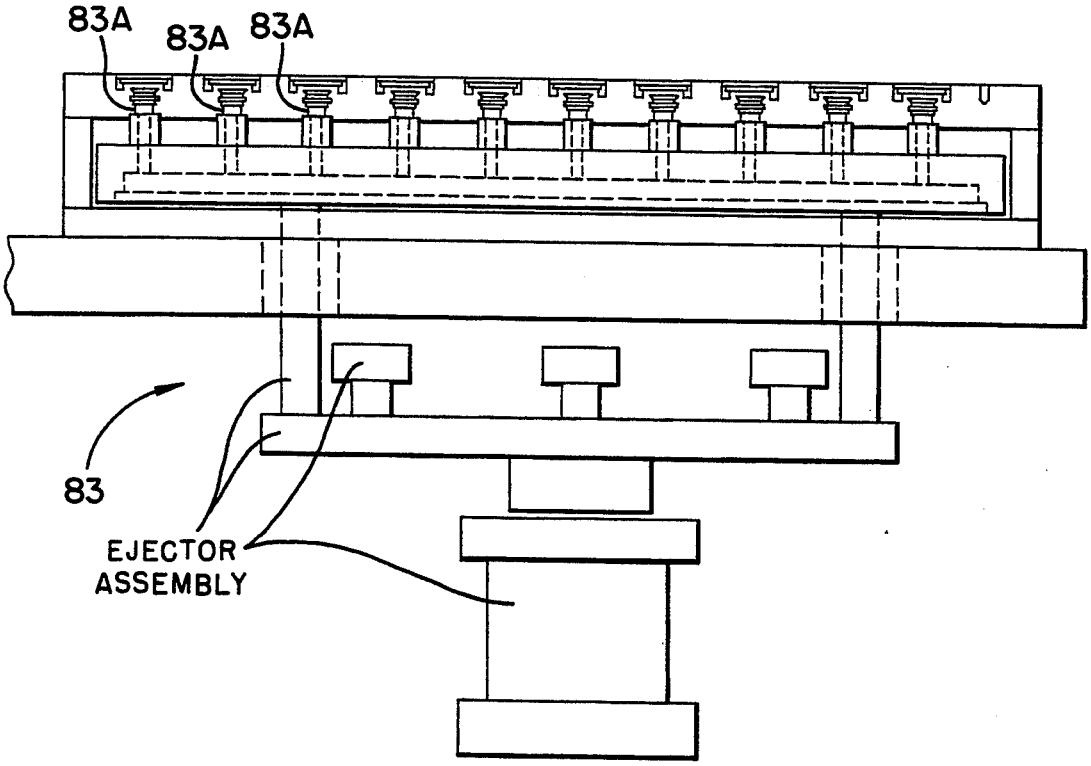
FIGS. 17-18 show schematically details of the ejector assembly of the apparatus of FIGS. 7-9.
Figure 18:
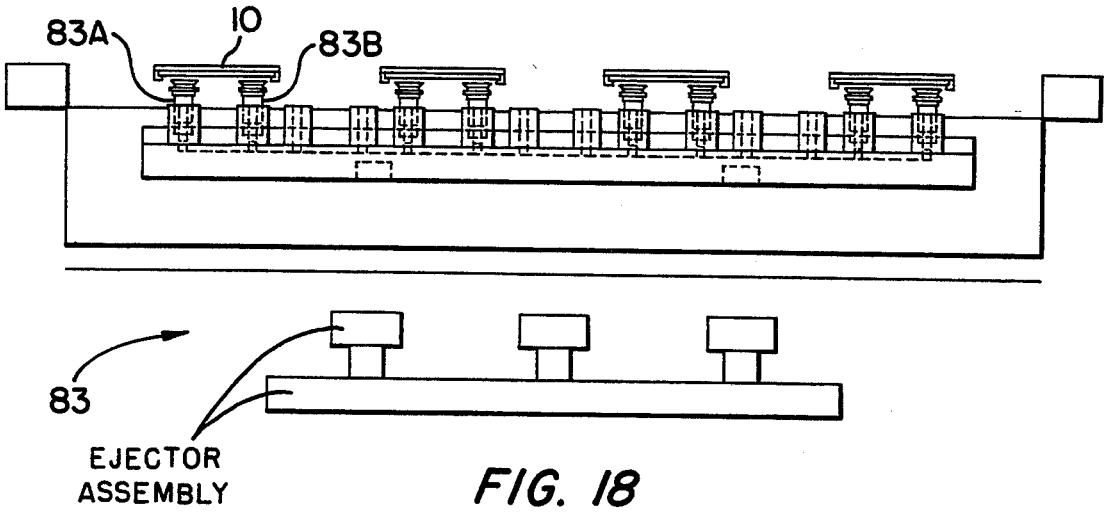

As is also shown, each die cavity 82A cooperates with pairs of ejector heads 83A and 83B of the ejector assembly 83. The latter assembly 83 is shown in greater detail in FIGS. 17 and 18 which depict the assembly along lines of die cavities 82A extending along the width and length, respectively, of the die assembly 82. In FIG. 17, the ejector heads are in the down position and in FIG. 18 the ejector heads are in the up position.

As can be seen from these figures and FIG. 13, the ejector heads 83A and 83B align with bores 82D and 82E in the lower sub-cavity 82C and in their down position (shown in FIGS. 13, 16 and 17) form part of the base of the sub-cavity. A further cavity 82F in the sub-cavity 82C is situated between the bores 82D and 82E and houses a magnetic piece 82G which is used for centering purposes, as will also be discussed below.

At the first station 81B of the table assembly 81, the segment 101A with the cut strips 1 is placed over the die assembly 82 until each strip 1 is centered over one of the die cavities 82A. A first mandrel array 84 situated at the station 81B comprises individual flat mandrels 84A arranged in checkerboard pattern corresponding to that of the die cavities 82A. Each die head of the array 84 furthermore has length and width dimensions $L_1$ and $W_1$ so that it can mate with the upper sub-cavity 82B of its die cavity 82A.

Upon actuation of the array 84, the mandrels 84A of the array are moved downward, causing the respective strips 1 on the segment 101A to be detached from the segment and forced into the respective sub-cavities 82B. The strips are thereby folded and caused to take on the shape of the strip 1 shown in FIG. 2.

The mandrels of the array 84 are then retracted, allowing the table 81A of the assembly 81 to be indexed, to bring the die assembly 82 from the first station to a second station 81C of the table assembly 81. At the station 81C, first magnetic elements 3 are assembled into a checkerboard array similar to the array of die cavities 82A of the die assembly 82. The array of magnetic elements 3 is then lifted and brought to a position in which the array of elements aligns with the cavity array. Lowering of the array seats each magnetic element onto the central surface of the strip 1 in a corresponding die cavity 82A. The magnetic elements are then released so that each now remains supported in its respective strip 1. Also, the force of the magnet 82G in each cavity 82A helps maintain the element 3 in a central position.

Once the placement of the magnetic elements 3 is completed, the table 81A is again indexed moving the die assembly 82A from the second station to a third station 81D where a second folding operation on the strips 1 is to be carried out. At this station, a second checkerboard mandrel array 85 is provided for interacting with the die cavities 82A of the die assembly 82. In this case, each mandrel head 85A is flat with length and width dimensions $L_2$ and $W_2$ so as to be commensurate with the lower sub-cavity 82C of the corresponding die cavity 82A. As a result, when the mandrel array 85 is lowered, each mandrel head mates with a corresponding sub-cavity 82C, thereby further folding the strip 1 in the cavity. This folding causes each strip to now take on the configuration shown in FIG. 3.

Figure 25A:
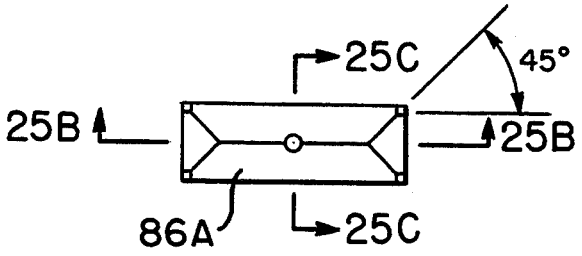
FIGS. 25A-25C show views of a mandrel head used with the die cavity assembly of the apparatus of FIGS. 7-9.
Figure 25B:
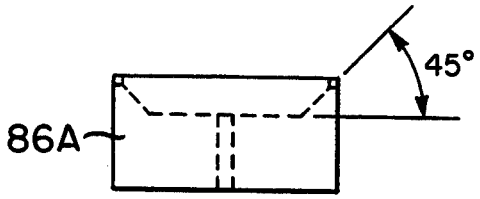
Figure 25C:
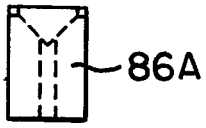

After the array 85 completes the second folding operation, the array is retracted and the table 81A again indexed, bringing the die assembly 82 from the third station to a fourth station 81E. At this station, a further checkerboard mandrel array 86 is provided for interacting with the array of die cavities 82A of the die assembly 82. As shown in FIGS. 25A–25C, each mandrel head 86A of the array 86 has flat sides angled outwardly at 45°. These sides terminate at their up ends to provide length and width dimensions slightly less than $L_2$ and $W_2$, respectively.

When the mandrel array 86 is lowered, each head 86A comes in contact with the side walls 1B–1E of the corresponding strip 1. This causes overbending at the bend lines $b_1$–$b_4$. As a result, the parts of strip above the bend lines, i.e., the continguous flap and side wall parts are urged together. The resultant strips 1, therefore, are left in the dies 82A with the configuration as shown in FIG. 4.

Figure 26A:
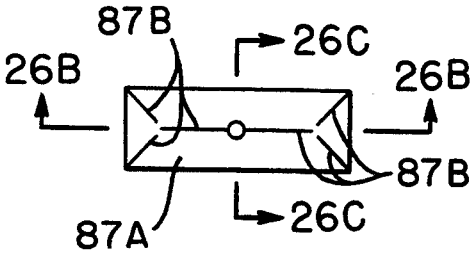
FIGS. 26A-26C show views of a further mandrel head used with the die cavity assembly of the apparatus of FIGS. 7-9.
Figure 26B:
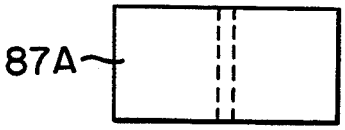
Figure 26C:
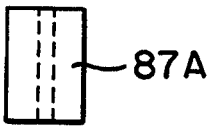

After the mandrel array 86 completes its forming operation, the array is retracted from the die assembly 82, allowing the table 81 to be indexed from the fourth station to a fifth station 81F. At this station, another checkerboard array of mandrels 87 similar to the array 86 is provided for interacting with the die assembly 82. In this case, each mandrel head 87A is dimensioned similar to the heads in the array 86, except that each head is flat with a slightly shouldered or raised pattern on the flat surface in the configuration of the flaps. This is illustrated in FIGS. 26A–26C, the shouldered pattern being shown as 87B.

When the array 86 is actuated, each mandrel head 87A interacts with the outer surface of the partially closed flap regions of its corresponding strip 1 causing overbending at the bend lines $b_5$–$b_8$. This, in turn, urges the flap regions together until they completely close while the side walls remain upstanding. The flaps as they close are prevented from overlapping by the shouldered pattern 87B. The resultant strip 1 in each die cavity 82A thus takes on the box-like body form 10 shown in FIG. 5.

After the folding operation at the station 81F, the die assembly 82 thus holds in its die cavities 82A an array of tag bodies 10. These tag bodies must now be provided with carriers 11 in order to complete each tag. To this end, the assembly 70 is further provided with a carrier forming assembly 91.

The carrier forming assembly 91 receives a release liner 12 supplied from a continuous liner roll 94. The liner 12 may comprise various materials. A typical material might be craft paper having a silicone coating on one side corresponding to the outer face or side 12A of the liner.

Figure 19:
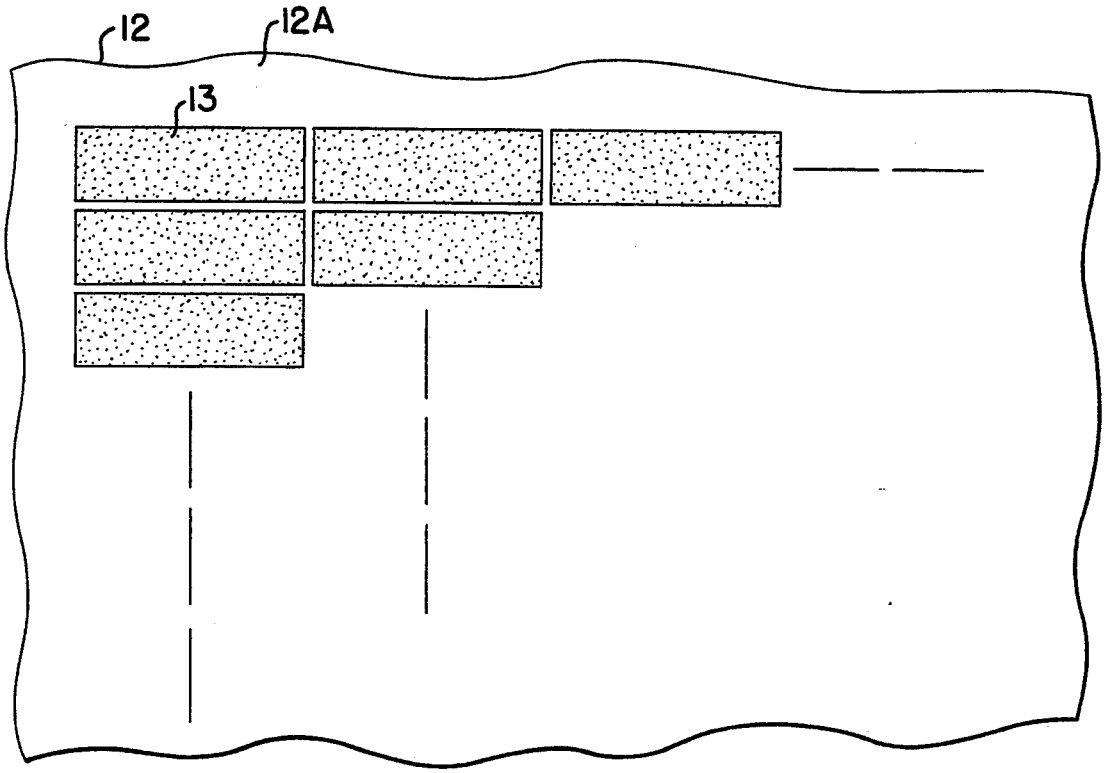
FIGS. 19-21 show a part of a carrier being formed by the apparatus of FIGS. 7-9 at various stages of formation.

The continuous liner 12 is pulled to a first adhesive or gluing station 91A of the assembly 91. At this station an adhesive pattern comprised of successive rows and columns of spaced rectangular adhesive segments 13 is applied to the side 12A of a segment 12B of the liner. Each adhesive segment 13 has length and width dimensions $L_2$ and $W_2$ and thus is commensurate with the outside dimensions of one of the tag bodies 10 in the cavity assembly 82. Each segment 13 is further spaced horizontally by a distance $L_2-L_1$ and vertically by a distance $W_2-W_1$, from its adjacent segments. These distances correspond to the horizontal and vertical displacement of the cavities 82A from their adjacent cavities in the assembly 82. The segment 12B of the liner 12 with the adhesive segments 13 applied is shown in FIG. 19.

After undergoing the adhesive application at the station 91A, the liner 12 is again pulled bringing the segment 12B to a second station 91B. At this station, a second magnetic element 14 is applied to each of the adhesive segments 13 on the liner segment 12B. Each element 14 has length and width dimensions $L_3$ and $W_3$.

Figure 20:
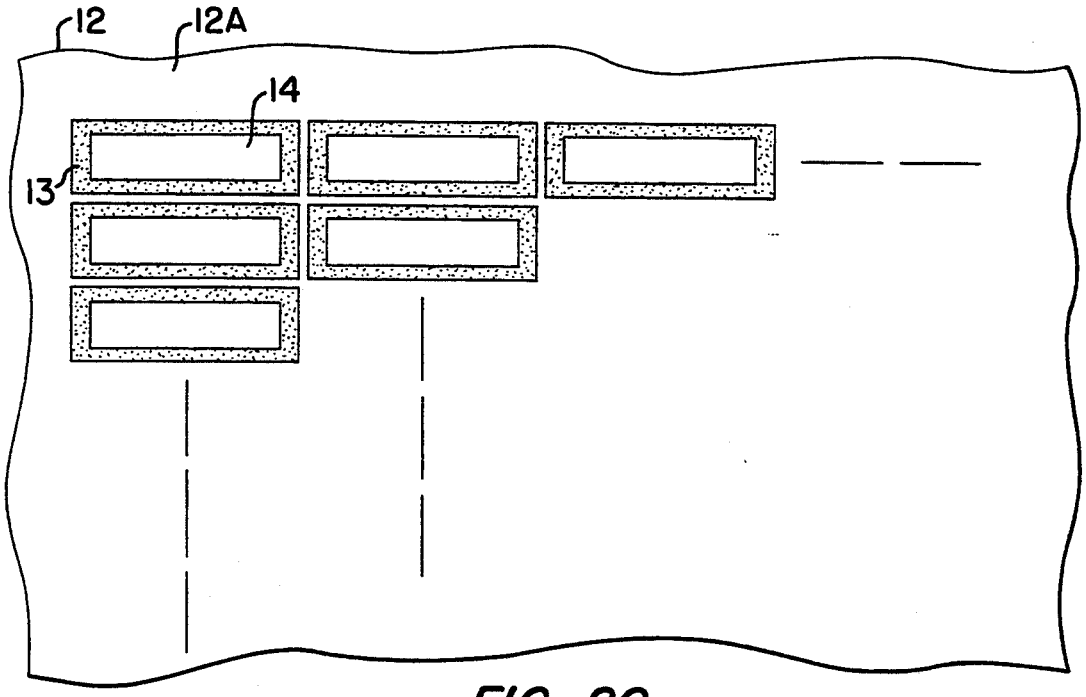

The second magnetic elements 14 are first arranged by a supply assembly 96 into an array similar to the adhesive array of segments 13. The supply assembly 96 then brings the array of magnetic elements over the liner segment 12B with the array of magnetic elements 14 aligned with the adhesive segment array. The magnetic elements 14 are then brought downward and pressed onto the corresponding adhesive segments 13 so as to adhere to the segments. The resultant liner segment 12B with the magnetic elements 14 and adhesive segments 13 is shown in FIG. 20.

Figure 21:
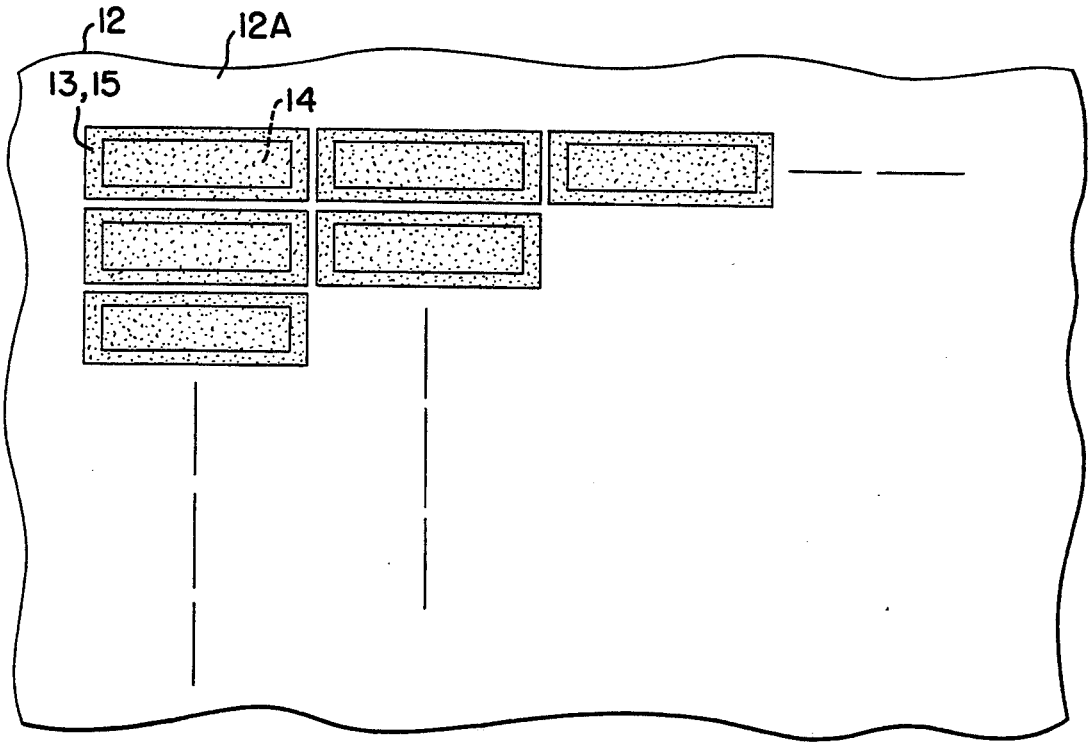

After the supply assembly 96 completes its operation, the liner 12 is pulled and segment 12B is carried to a further station 91C of the forming assembly 91. At this station, a further glue or adhesive segment array like the first adhesive segment array is applied to the liner. Thus, an adhesive segment 15 is applied over and covers each magnetic element 14 and its associated adhesive segment 13. The liner segment 12B after this second adhesive application is shown in FIG. 21.

Once the liner segment 12B has received the second adhesive segments, each laminate of liner 12, first adhesive segment 13, second magnetic element 14 and second adhesive segment 15 defines a carrier 11. The array of carriers 11 defined by the liner segment 12B is then brought to a sixth station 81G of the table 81. Also brought to this station by further indexing of the table 81A, is the die assembly 82 with the formed tag bodies 10 which are to be joined to the carriers 11 to form completed tags 20.

In pulling the liner 12 to bring the liner segment 12B to the station 81G, the liner is turned over so that the segment side 13A of the liner segment 12B with the carriers 11 faces downwardly toward the cavity assembly 82 holding the tag bodies 10. With the liner segment in this position each of the carriers 11 is brought into alignment with one of the cavities 82A. The ejectors 83A and 83B of the ejector assembly 83 are then actuated so as to bring the ejectors to their up position (see, FIG. 18). This moves the tag bodies 10 in the corresponding cavities 82A upward into contact with the adhesive segments 15 of the corresponding carriers 11. The tag bodies 10 thus adhere to the segments and are released from the cavities.

Figure 22:
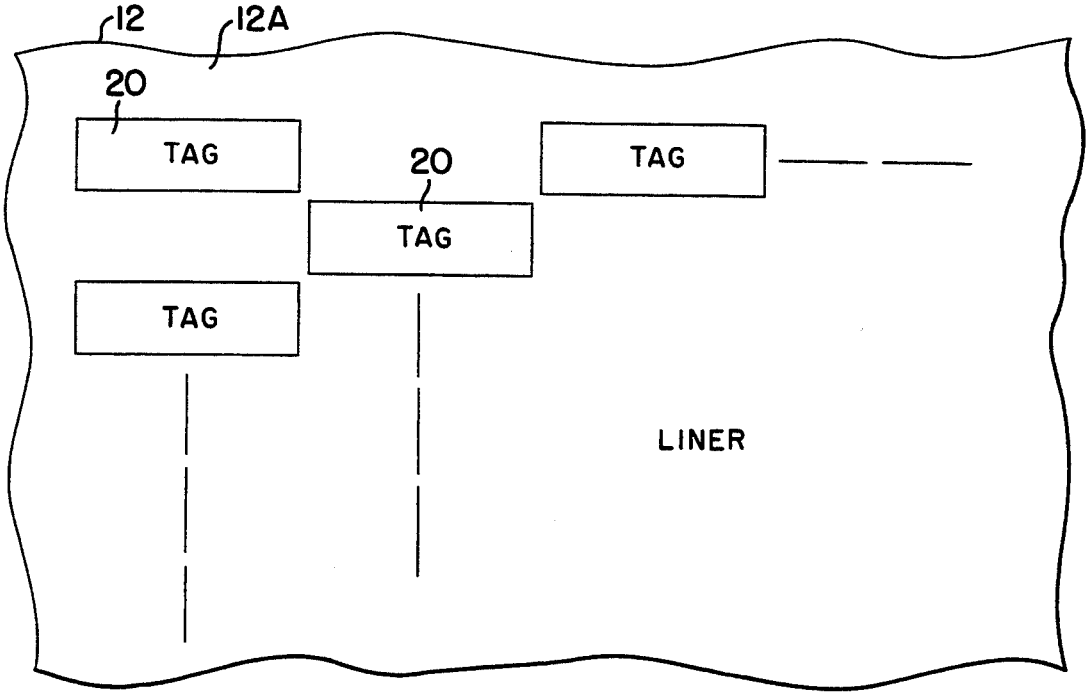
FIGS. 22-23 show completed tags formed by the apparatus of FIGS. 7-9.
Figure 23:
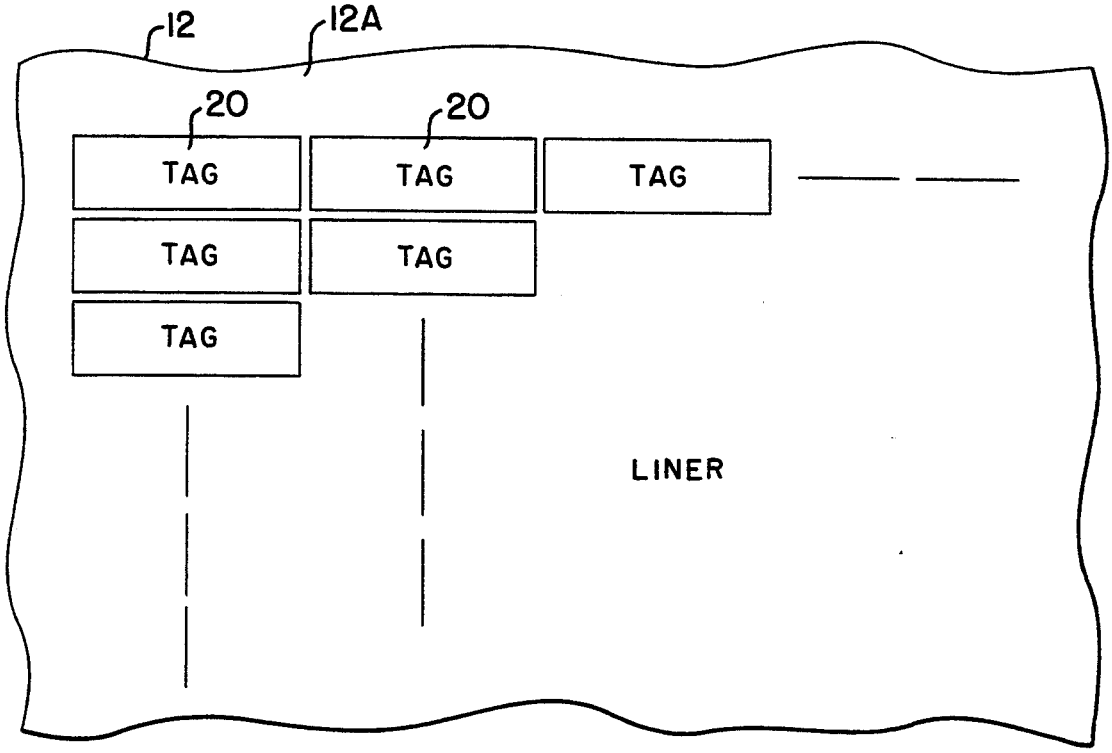

The resultant checkerboard pattern of completed tags 20 on the liner segment 12B is shown in FIG. 22. In order to now also form completed tags using the empty intermediate carrier locations, the liner 12 is indexed backward one tag width and the table 81A is indexed to bring another cavity assembly 82 with another checkerboard pattern of tag bodies 10 under the indexed liner. Due to the indexing, the empty intermediate carrier locations of the liner segment 12B now align with the cavities 82A holding the tag bodies 10 of the further cavity assembly.

By actuating the ejectors accompanying this further cavity assembly, the tag bodies 10 held in the assembly are secured to the adhesive segments 15 at the intermediate carrier locations. The resultant liner segment 12B is shown in FIG. 22 and comprises a rectangular array of spaced completed tags 20.

After formation of the tag array 20, the liner 12 is pulled so that liner segment 12B is carried from the station 81G to a storage station 98 of the carrier forming assembly 91. At this station, the liner segment 12B may be rolled or zig-zag folded with other segments of the liner 12 for storing purposes. The stored segments may be later separated into individual tags or into groups of tags by suitable slitting of the liner in the spaces between the individual tags.

The apparatus 70 thus provides for continuous fabrication of large quantities of tags 20 in an efficient and easy manner.

Figure 24:
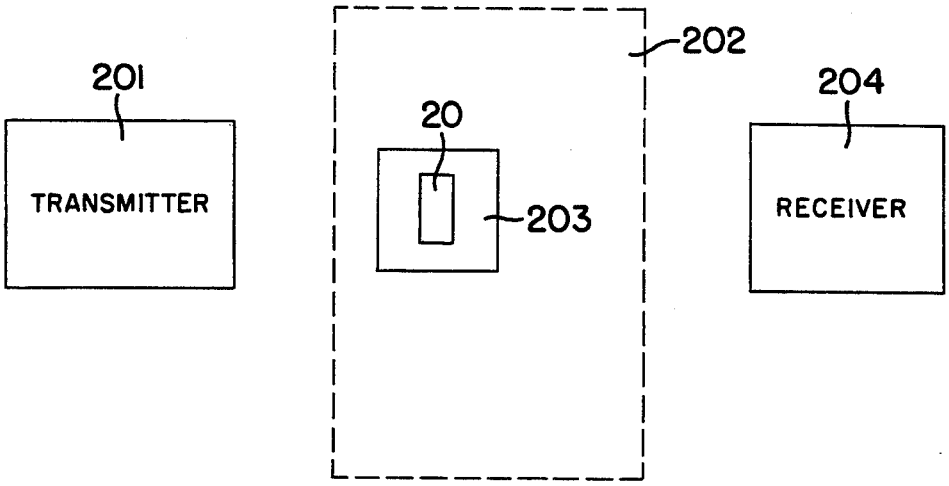
FIG. 24 shows an EAS system using a tag as shown in FIG. 6.

FIG. 24 shows an EAS system utilizing the tag 20 of FIG. 6. As shown, a transmitter 201 transmits a magnetic field at a predetermined frequency into an interrogation zone 202 in which an article 203 carrying a tag 20 is located.

The magnetic element 3 of tag 20 is adapted to be able to mechanically vibrate at the predetermined frequency and the magnetic element 14 of the tag is magnetized to bias the element 3 so it can undergo such vibration. A receiver 204 receives magnetic energy or a magnetic signal at the predetermined frequency as a result of the interaction of the tag 20 with the field transmitted from the transmitter. As a result, the presence of the tag and, thus, the article 203 in the zone 202 can be detected. The transmitter 201 and the receiver 204 can be of the type described in the '489 and '490 patents.

In the embodiments of the invention discussed above, the tag 20 of invention included a first magnetic element 3 housed within the box-like housing or body 10 and a second magnetic element 14 for housing the first magnetic element 3 and carried by carrier 11 secured to the outside of the body 10. It is also within the contemplation of the invention that the tag be formed with second magnetic element arranged within the body 10 instead of carried by the carrier 11. While this can be accomplished in various ways, one way is to form the magnetic element 14 as part of the magnetic element 3 as, for example, a semi-hard or hard magnetic surface layer of the magnetic element 3. In such case, the carrier 11 could then be a simple laminate of the liner 12 and an adhesive layer.

Figure 7:
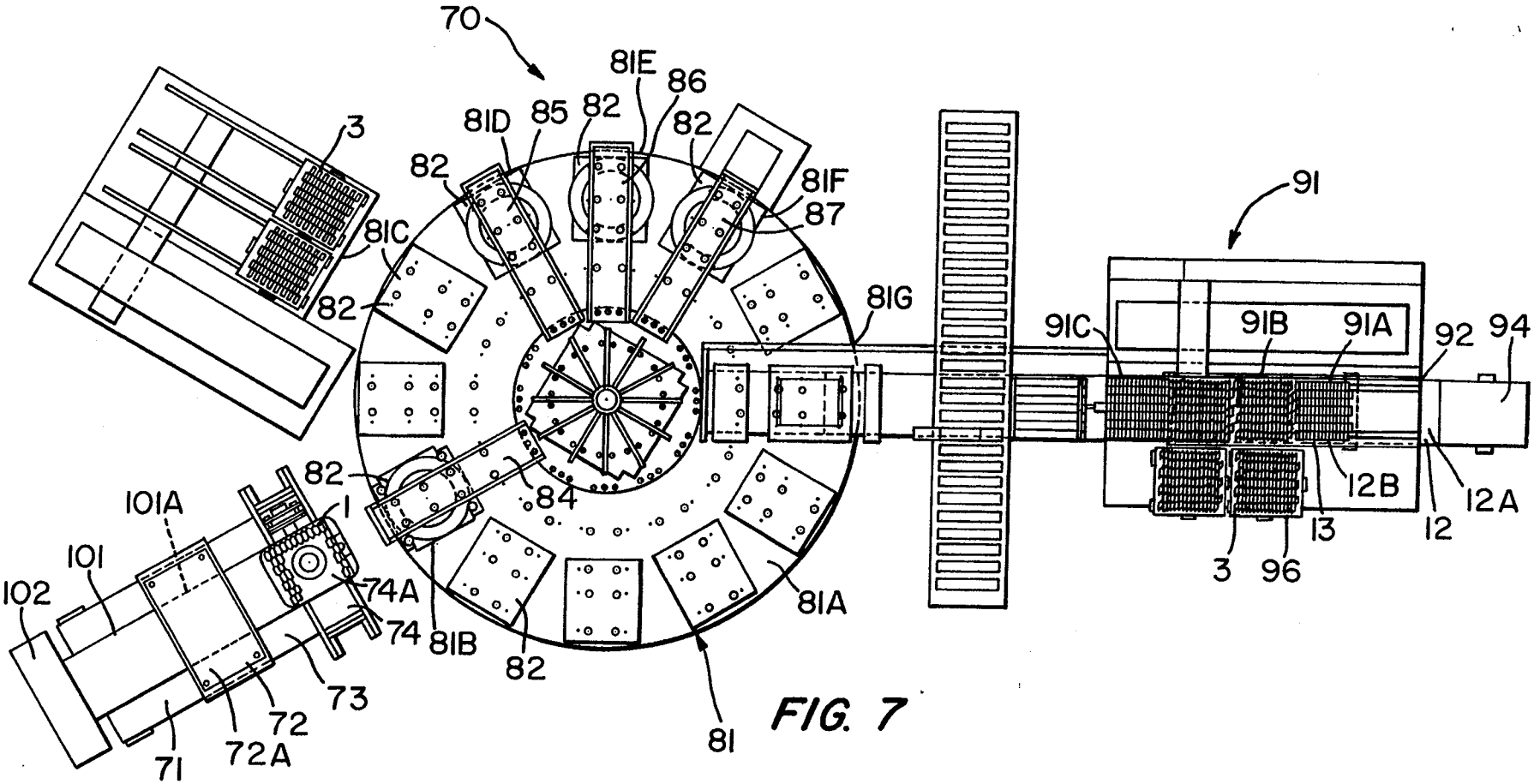
FIGS. 7-9 show various views of an apparatus for fabricating multiple tags of the invention in accordance with the forming procedure described in connection with FIGS. 1-6.
Figure 8:
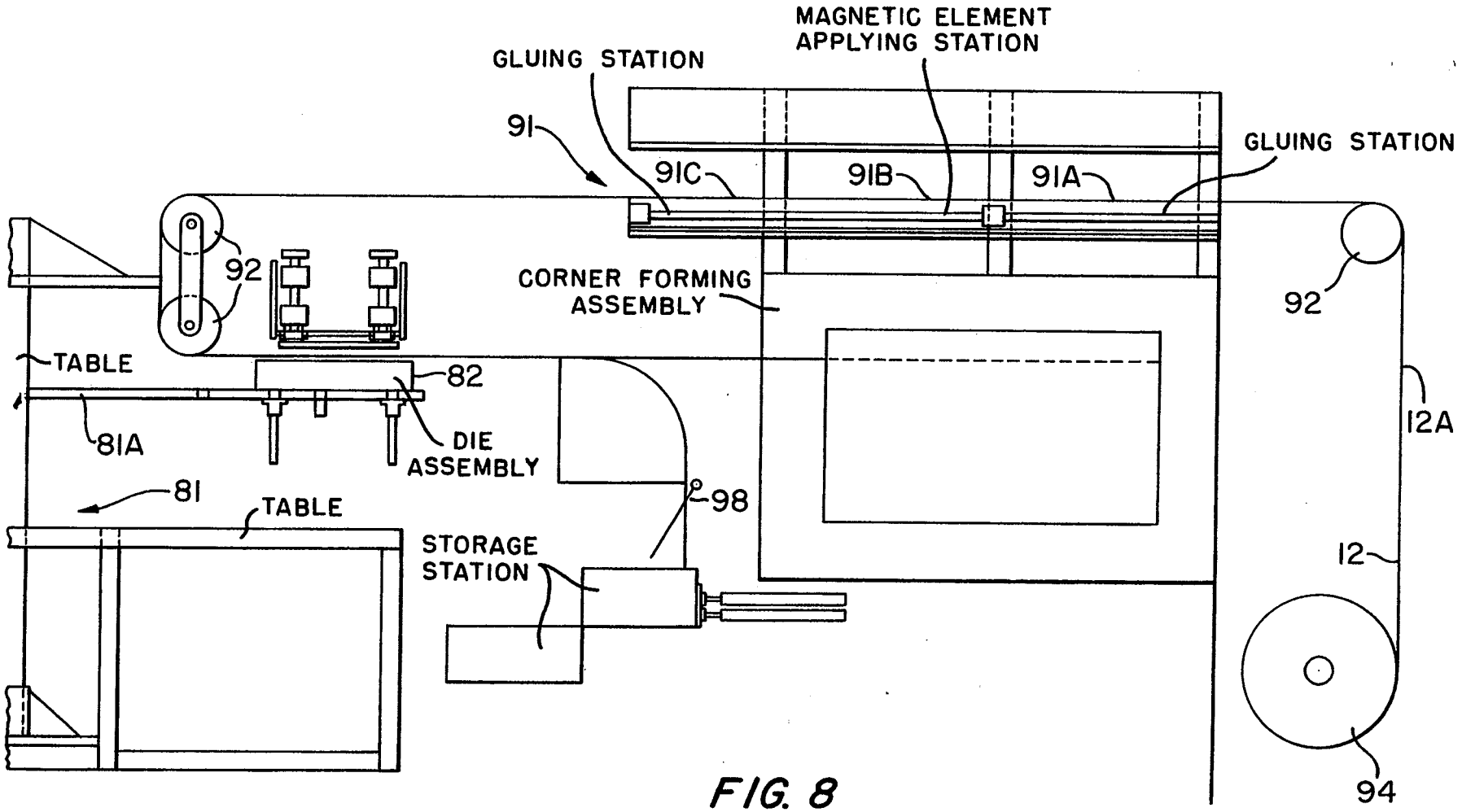
Figure 9:
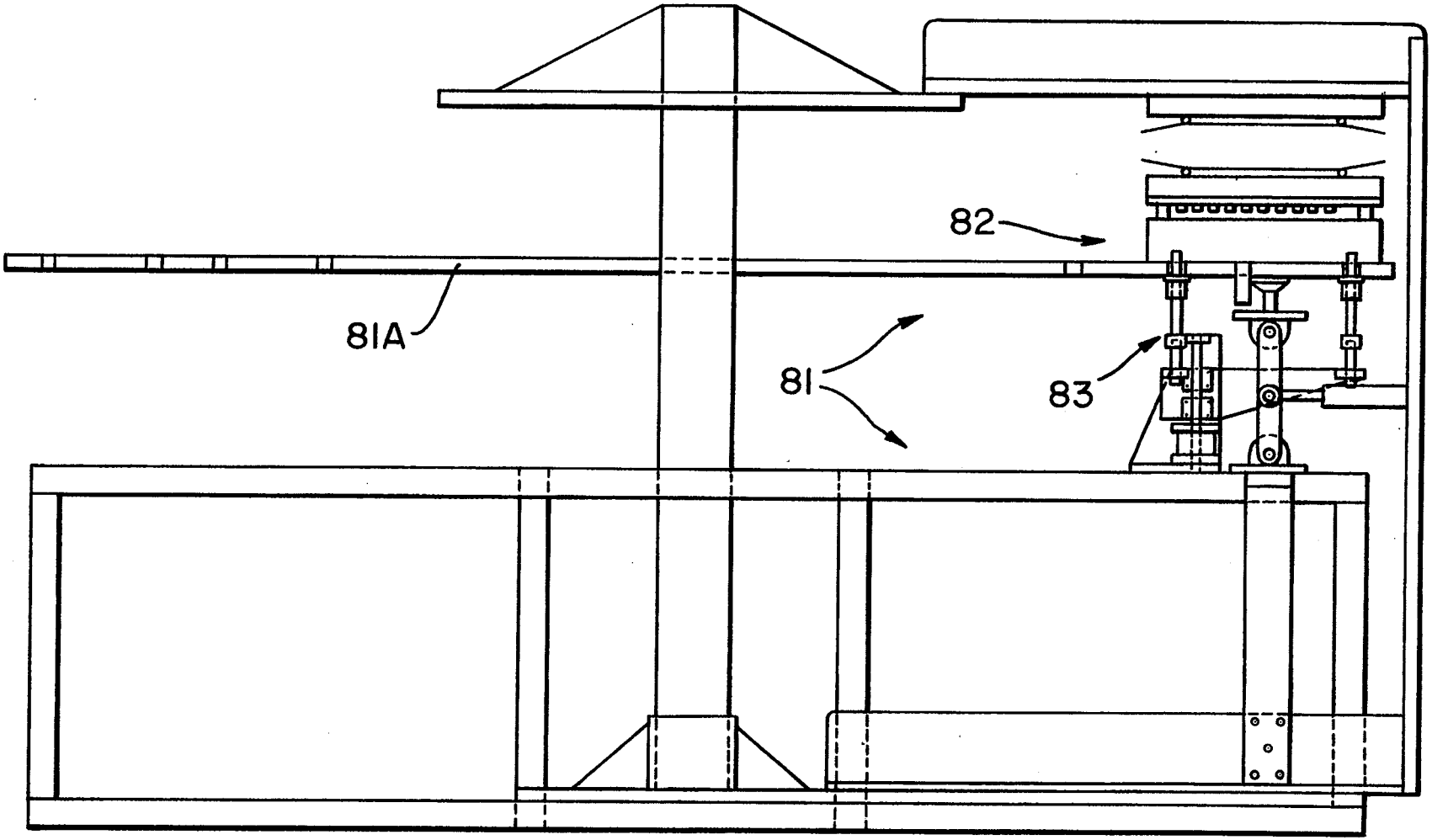

It should also be noted that in the description of the apparatus of FIGS. 7–9, a continuous web of material 101 was pulled from a roll 102 and segments 101A of the continuous roll were processed and then subsequently cut in forming the strips 1. The apparatus can also be constructed such that individual segments 101A of material are first cut from the continuous web and the individual segments then processed. In this case, the cut segments would be processed in the same manner as they were when attached to the web.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. An EAS tag comprising:

a tag body including: a central region; side wall regions connected to and integral with the central region; first fold lines at the junctions of said central region and said side wall regions at which said side wall regions are folded; flap regions connected to and integral with said side wall regions; and second fold lines at the junctions of said side wall regions and said flap regions at which said flap regions are folded so as to come together to form a closed cover facing and spaced from said central region, thereby forming a closed housing;

and a first magnetic element, said first magnetic element being disposed in said closed housing and mechanically vibrating in response to an interrogation field.

2. An EAS tag in accordance with claim 1 further comprising:

a second magnetic element which when magnetized arms said first magnetic element to mechanically vibrate in response to an interrogation field;

and means for securing said second magnetic element to said tag body.

3. An EAS tag in accordance with claim 2 wherein: said securing means secures said second magnetic element to said cover of said tag body.

4. An EAS tag in accordance with claim 3 wherein: said securing means comprises: a liner; and an adhesive means on one side of said liner from which said liner peeled;

said second magnetic element being secured to said adhesive means;

and said adhesive means securing said securing means to said cover of said tag body.

5. An EAS tag in accordance with claim 4 wherein: said adhesive means has a length and width which are at least commensurate with the length and width, respectively, of said cover of said tag body.

6. An EAS tag in accordance with claim 5 wherein: said second magnetic element has a length and width which are less than the length and width, respectively, of said adhesive means.

7. An EAS tag in accordance with claim 4 wherein: said adhesive means includes: a first adhesive layer on said one side of said liner; said second magnetic element being adhered to said first adhesive layer; and a second adhesive layer overlying said second magnetic element and said first adhesive layer.

8. An EAS tag in accordance with claim 7 wherein: said first and second layers have lengths and widths which are at least commensurate with the length and width, respectively, of said cover of said tag body.

9. An EAS tag in accordance with claim 8 wherein: said second magnetic element has a length and width which are less than the lengths and widths, respectively, of said first and second layers.

10. An EAS tag in accordance with claim 2 wherein: said first magnetic element is a ferromagnetic element;

and said second magnetic element is a hard or semi-hard magnetic element.

11. An EAS tag in accordance with claim 10 wherein: said first magnetic element is a magnetostrictive element.

12. An EAS tag in accordance with claim 1 wherein: said first magnetic element has a length and width which are less than the length and width, respectively, of said central region and a thickness which is less than the height of said side wall regions.

13. An EAS tag in accordance with claim 1 wherein: said flap regions have edges which mate when said flap regions are together forming said closed cover.

14. An EAS tag in accordance with claim 1 wherein: said central region is rectangular having first and second opposing longer sides and first and second opposing shorter sides;

said side wall regions comprise first, second, third and fourth rectangular side wall regions, said first and second side wall regions being integral with said first and second longer sides of said central region and said third and fourth side wall regions being integral with said first and second shorter sides of said central region;

and said flap regions comprise first and second triangular flap regions integral with said third and fourth side wall regions, and third and fourth trapezoidal flap regions integral with said first and second side wall regions.

15. An EAS tag in accordance with claim 14 wherein: said flap regions have edges which mate when said flap regions are together forming said closed cover.

16. An EAS tag in accordance with claim 15 wherein: the heights of said side wall regions are equal.

17. An EAS tag in accordance with claim 16 wherein: the lengths of the sides of said triangular and trapezoidal flap regions are equal.

18. An EAS tag in accordance with claim 1 wherein: said tag body when unfolded forms a hexagonal strip having first, second, third, fourth, fifth and sixth sides, said first and fourth sides being opposing and parallel, said second and fifth sides being opposing and parallel, and said third and sixth sides being opposing and parallel, said second, third, fifth and sixth sides being of equal first length and said first and fourth sides being of equal second length greater than said first length, each of said second, third, fifth and sixth sides having an L shaped notch positioned and dimensioned such that the length of the respective second, third, fifth and sixth side from one end of the respective second, third, fifth add sixth side to the point at which the legs of the L shaped notch of the respective second, third, fifth and sixth side intersect each other is equal to the length of the respective second, third, fifth and sixth side from the other end of the respective Second, third, fifth and sixth side to said point where the legs of the L shaped notch of the respective second, third, fifth and sixth side intersect each other.

19. An EAS tag in accordance with claim 18 wherein: the legs of the notch of the second side intersect the second side at respective first and second intersection points and interest each other at a third intersection point;

the legs of the notch of the third side intersect the third side at respective fourth and fifth intersection points and each other at a sixth intersection point;

the legs of the notch of the fifth side intersect the fifth side at respective seventh and eight intersection points and each other at a ninth intersection;

the legs of the notch of the sixth side intersect the sixth side at the respective tenth and eleventh intersection points and each other at a twelfth intersection point;

said second set of fold lines connect said first and fourth, second and eleventh, fifth and seventh, and eight and tenth intersection points;

and said first set of fold lines connect said third and sixth, sixth and ninth, ninth and twelfth, and twelfth and third intersection points.

20. An EAS tag in accordance with claim 1 further comprising:

a second magnetic element which when magnetized arms said first magnetic element to mechanically vibrate in response to an interrogation field, said second magnetic element being disposed in said housing.

21. An EAS tag in accordance with claim 1 wherein: said first magnetic element comprises a first magnetic part which when magnetized arms said first magnetic element to mechanically vibrate in response to an interrogation field.

22. An EAS tag in accordance with claim 21 wherein:

said first magnetic part forms a surface portion of said first magnetic element.

23. An EAS tag in accordance with claim 1 further comprising:

a liner;

an adhesive means on one side of said liner from which said liner is peeled; and said adhesive means being secured to said cover of said tag body.

24. An EAS tag in accordance with claim 23 wherein:

said first magnetic element comprises a first magnetic part which when magnetized arms said first magnetic element to mechanically vibrate in response to an interrogation field.

25. Apparatus for forming an EAS tag comprising:

supply means for supplying a strip of material: and die and mandrel assembly means for: receiving said strip of material from said supply means; folding said strip of material to form a first set of fold lines defining flap regions; folding said strip of material to form a second set of fold lines defining side wall regions and a central region, said side wall regions being integral with said flap regions and said central region being integral with said side wall regions, said first set of fold lines being at the junctions of said flap regions and said side wall regions and said second set of fold lines being at the junctions of said side wall regions and said central region; disposing a first magnetic element in said central region; and folding said flaps to cause said flaps to come together to form a closed cover facing and spaced from said central region; thereby forming a closed housing with said first magnetic element held therein to define a tag body.

26. Apparatus in accordance with claim 25 further comprising:

means for forming a carrier including a second magnetic element which when magnetized arms said first magnetic element to mechanically vibrate in response to an interrogation field;

and means for causing said carrier and said housing to be secured together.

27. Apparatus in accordance with claim 26 wherein:

said means for causing causes said carrier and said cover of said housing to be secured together.

28. Apparatus in accordance with claim 27 wherein:

said carrier forming means includes: means for supplying a liner; means for applying an adhesive means to said liner and for enabling said second magnetic element to be adhered to said adhesive means;

and said means for causing causes said adhesive means and said cover of said housing to be secured together.

29. Apparatus in accordance with claim 28 wherein:

said adhesive applying means includes: means for applying a first adhesive layer to said liner; means for enabling said second magnetic element to be adhered to said first adhesive layer; and means for applying a second adhesive layer over said second magnetic element and said first adhesive layer;

and said means for causing causes said second adhesive layer and said cover of said housing to be secured together.

30. Apparatus in accordance with claim 25 wherein:

said strip of material is hexagonal and has first, second, third, fourth, fifth and sixth sides, said first and fourth sides being opposing and parallel, said second and fifth sides being opposing and parallel, and said third and sixth sides being opposing and parallel, said second, third, fifth and sixth sides being of equal first length and said first and fourth sides being of equal second length greater than said first length, each of said second, third, fifth and sixth sides having an L shaped notch positioned and dimensioned such that the length of the respective second, third, fifth and sixth side from one end of the respective second, third, fifth and sixth side to the point at which the legs of the L shaped notch of the respective second, third fifth and sixth side intersect each other is equal to the length of the respective second, third, fifth and sixth side from the other end of the respective second, third, fifth and sixth side to said point where the legs of the L shaped notch of the respective second, third, fifth and sixth side intersect each other.

31. Apparatus in accordance with claim 30 wherein:

the legs of the notch of the second side intersect the second side at respective first and second intersection points and interest each other at a third intersection point;

the legs of the notch of the third side intersect the third side at respective fourth and fifth intersection points and each other at a sixth intersection point;

the legs of the notch of the fifth side intersect the fifth side at respective seventh and eight intersection points and each other at a ninth intersection;

the legs of the notch of the sixth side intersect the sixth side at the respective tenth and eleventh intersection points and each other at a twelfth intersection point;

said first set of fold lines connect said first and fourth, second and eleventh, fifth and seventh, and eighth and tenth intersection points;

and said second set of fold lines connect said third and sixth, sixth and ninth, ninth and twelfth, and twelfth and third intersection points.

32. Apparatus in accordance with claim 25 wherein:

said die and mandrel assembly means includes: a die cavity having upper and lower sub-cavities, said lower sub-cavity being of smaller dimension than said upper sub-cavity.

33. Apparatus in accordance with claim 32 wherein:

said lower sub-cavity includes a magnetic means.

34. Apparatus in accordance with claim 32 wherein:

said die and mandrel assembly means further includes: a first die head of dimension equal to the dimension of said upper sub-cavity for interacting with said upper sub-cavity and said strip to fold said strip to form said first set of fold lines; a second die head of dimension equal to the dimension of said lower sub-cavity for interacting with said lower sub-cavity and said strip to form said second set of fold lines; and one or more further die heads of dimension slightly less than the dimension of said lower sub-cavity for interacting with said strip to fold said flap regions.

35. Apparatus in accordance with claim 34 wherein:

said one or more further die heads include a third die head of configuration so as to interact with the side wall regions of said strip to partially fold said flap regions and a fourth die head of configuration so as to interact with said flap regions to fully fold said partially folded flap regions to provide said cover.

36. Apparatus in accordance with claim 34 wherein:

said lower sub-cavity includes at least one bore;

and said apparatus further includes means in said bore for urging said strip from said die cavity.

37. Apparatus in accordance with claim 34 wherein:

said die and mandrel assembly means further includes: an indexing table carrying said die cavity; and means for indexing said table to bring said die cavity to first, second and one or more further stations adjacent said table;

and said first, second and one or more further die heads being situated at said first, second and one or more further stations, respectively.

38. An apparatus in accordance with claim 25 wherein:

said first magnetic element mechanically vibrates in response to an interrogation field.

39. A method of forming an EAS tag comprising the steps of:

folding a strip of material to form a first set of fold lines defining flap regions;

folding said strip of material to form a second set of fold lines defining side wall regions and a central region, said side wall regions being integral with said flap regions and said central region being integral with said side wall regions, said first set of fold lines being at the junctions of said flap regions and said side wall regions and said second set of fold lines being at the junctions of said side wall regions and said central region;

disposing a first magnetic element said central region;

and folding said flaps to cause said flaps to come together to form a closed cover facing and spaced from said central region;

thereby forming a closed housing with said first magnetic element held therein to define a tag body.

40. A method in accordance with claim 39 further comprising:

securing together said tag body and a carrier which includes a second magnetic element which when magnetized arms said first magnetic element to mechanically vibrate in response to an interrogation field.

41. A method in accordance with claim 40 wherein:

said securing step is carried out by securing said carrier and said cover of said tag body together.

42. A method in accordance with claim 41 wherein:

said securing step is carried out by securing an adhesive layer included on said carrier and said cover of said tag body together.

43. A method in accordance with claim 40 further comprising steps for forming said carrier, including: applying a first adhesive layer to a liner; applying said second magnetic element to said first adhesive layer; and applying a second adhesive layer over said first adhesive layer and second magnetic element.

44. A method in accordance with claim 43 wherein:

said securing step is carried out by securing said second adhesive layer of said carrier and said cover of said tag body together.

45. A method in accordance with claim 39 wherein:

said strip of material is hexagonal and has first, second, third, fourth, fifth and sixth sides, said first and fourth sides being opposing and parallel, said second and fifth sides being opposing and parallel, and said third and sixth sides being opposing and parallel, said second, third, fifth and sixth sides being of equal first length and said first and fourth sides being of equal second length greater than said first length, each of said second, third, fifth and sixth sides having L shaped notches positioned and dimensioned such that the length of the respective second, third, fifth and sixth side from one end of the respective second, third, fifth and sixth side to the point at which the legs of the L shaped notch of the respective second, third, fifth and sixth side intersect each other is equal to the length of the respective second, third, fifth and sixth side from the other end of the respective second, third, fifth and sixth side to said point where the legs of the L shaped notch of the respective second, third, fifth and sixth side intersect each other.

46. A method in accordance with claim 45 wherein:

the legs of the notch of the second side intersect the second side at respective first and second intersection points and interest each other at a third intersection point;

the legs of the notch of the third side intersect the third side at respective fourth and fifth intersection points and each other at a sixth intersection point;

the legs of the notch of the fifth side intersect the fifth side at respective seventh and eight intersection points and each other at a ninth intersection;

the legs of the notch of the sixth side intersect the sixth side at the respective tenth and eleventh intersection points and each other at a twelfth intersection point;

said first set of fold lines connect said first and fourth, second and eleventh, fifth and seventh, and eighth and tenth intersection points;

and said second set of fold lines connect said third and sixth, sixth and ninth, ninth and twelfth, and twelfth and third intersection points.

47. A method in accordance with claim 39 wherein:

a second magnetic element which when magnetized arms said first magnetic element to mechanically vibrate in response to an interrogation field is disposed in said closed housing.

48. A method in accordance with claim 39 wherein:

said first magnetic element comprises a first magnetic part which when magnetized arms said first magnetic element to mechanically vibrate in response to an interrogation field.

49. A method in accordance with claim 48 wherein:

said first magnetic part forms a surface portion of said first magnetic element.

50. A method of forming an EAS tag in accordance with claim 39 wherein:

said first magnetic element mechanically vibrates in response to an interrogation field.

51. An EAS system comprising:

means for transmitting a first magnetic field into an interrogation zone;

an EAS tag comprising: a central region; side wall regions connected to and integral with the central region; first fold lines at the junctions of said central region and said side wall regions at which said side wall regions are folded; flap regions connected to and integral with said side wall regions; and second fold lines at the junctions of said side wall regions and said flap regions at which said flap regions are folded so as to come together to form a closed cover facing and spaced from said central region, thereby forming a closed housing defining a tag body; and a first magnetic element, said first magnetic element being disposed in said closed housing;

and means for receiving a magnetic signal resulting from the interaction of said first magnetic field and said EAS tag for detecting the presence of said EAS tag in said interrogation zone.

52. An EAS system in accordance with claim 51 wherein:

said EAS tag further comprises:

a second magnetic element which when magnetized arms said first magnetic element to mechanically vibrate in response to said first magnetic field;

and means for securing said second magnetic element to said tag body.

53. An EAS system in accordance with claim 52 wherein:

said securing means secures said second magnetic element to said cover of said tag body.

54. An EAS system in accordance with claim 51 wherein:

said EAS tag further comprises:

a second magnetic element which when magnetized arms said first magnetic element to mechanically vibrate in response to said first magnetic field, said second magnetic element being disposed in said housing.

55. An EAS system in accordance with claim 51 wherein:

said first magnetic element comprises a first magnetic part which when magnetized arms said first magnetic element to mechanically vibrate in response to said first magnetic field.

56. An EAS system in accordance with claim 55 wherein:

said first magnetic part forms a surface portion of said first magnetic element.

57. An EAS system in accordance with claim 51 wherein:

said first magnetic element mechanically vibrates in response to said first magnetic field.

58. A method of operating an EAS system comprising:

transmitting a first magnetic field in an interrogation zone;

situating an EAS tag in said interrogation zone, said EAS tag comprising: a central region; side wall regions connected to and integral with the central region; first fold lines at the junctions of said central region and said side wall regions at which said side wall regions are folded; flap regions connected to and integral with said side wall regions; and second fold lines at the junctions of said side wall regions and said flap regions at which said flap regions are folded so as to come together to form a closed cover facing and spaced from said central region, thereby forming a closed housing defining a tag body; and a first magnetic element, said first magnetic element being disposed in said closed housing;

and receiving a magnetic signal resulting from the interaction of said first magnetic field and said EAS tag for detecting the presence of said EAS tag in said interrogation zone.

59. A method in accordance with claim 58 wherein:

said EAS tag further comprises: a second magnetic element which when magnetized arms said first magnetic element to mechanically vibrate in response to said first magnetic field;

and means for securing said second magnetic element to said tag body.

60. A method of operating an EAS system in accordance with claim 58 wherein:

said EAS tag further comprises:

a second magnetic element which when magnetized arms said first magnetic element to mechanically vibrate in response to said first magnetic field, said second magnetic element being disposed in said housing.

61. A method of operating an EAS system in accordance with claim 58 wherein:

said first magnetic element comprises a first magnetic part which when magnetized arms said first magnetic element to mechanically vibrate in response to said first magnetic field.

62. A method of operating an EAS system in accordance with claim 61 wherein:

said first magnetic part forms a surface portion of said first magnetic element.

63. A method of operating an EAS system in accordance with claim 58 wherein:

said first magnetic element mechanically vibrates in response to said first magnetic field.

* * * * *

UNITED STATES PATENT AND TRADEMARK OFFICE

CERTIFICATE OF CORRECTION

PATENT NO. : 5,357,240

DATED : October 18, 1994

INVENTOR(S) : Robert J. Sanford et al.

It is certified that error appears in the above-identified patent and that said Letters Patent is hereby corrected as shown below:

Col. 8, line 3. Change "continguous" to -- contiguous --.

Col. 10, line 18. Change "the tag 20 of" to -- tag 20 of the --.

Col. 11, line 12. After "liner" insert -- is --.

Col. 12, line 26. Change "add" to -- and --.

Col. 12, line 31. Change "Second" to -- second --.

Col. 12, line 44. Change "eight" to -- eighth --.

Col. 12, line 52. Change "eight" to -- eighth --.

Col. 14, line 12. After "third" insert -- , --.

Col. 16, line 16. Change "interest" to -- intersect --.

Signed and Sealed this

Seventeenth Day of January, 1995

*Attest:*

Bruce Lehman

BRUCE LEHMAN

*Attesting Officer*

*Commissioner of Patents and Trademarks*